United States Patent [19]

Ono

[11] 4,171,848

[45] Oct. 23, 1979

[54] CONTROL METHOD AND SYSTEM FOR ENSURING STABLE BORING OPERATION AT WORKING FACE DURING TUNNELLING WITH TUNNEL BORING OR SHIELD MACHINE

[75] Inventor: Kozo Ono, Tsuchiura, Japan

[73] Assignee: Hitachi, Ltd., Japan

[21] Appl. No.: 838,248

[22] Filed: Sep. 30, 1977

[30] Foreign Application Priority Data

Oct. 13, 1976 [JP] Japan ..... 51-121903

[51] Int. Cl.[2] ..... E21D 9/04

[52] U.S. Cl. ..... 299/1; 299/33; 405/141

[58] Field of Search ..... 299/1, 18, 31, 33; 61/85; 222/413; 405/136, 137, 138, 141, 144

[56] References Cited

U.S. PATENT DOCUMENTS

| | | | |
|---|---|---|---|
| 1,529,379 | 3/1925 | Thompson | 222/413 |
| 3,769,804 | 11/1973 | Matsushima | 61/85 |
| 3,881,777 | 5/1975 | Altseiner | 299/33 |
| 3,961,825 | 6/1976 | Lovat | 299/33 |
| 4,040,666 | 8/1977 | Uchida | 299/1 |

*Primary Examiner*—William Pate, III

*Attorney, Agent, or Firm*—Craig and Antonelli

[57] ABSTRACT

In a tunnel boring or shield machine including a chamber defined between a working face and a bulkhead mounted in a machine frame of a shield machine body, means for controlling the amount of earth or muck conveyed to the exterior of the shield machine from the chamber in which earth is accumulated, and drive means for propelling the shield machine body toward and into the working face, a control method and system for ensuring stable boring operation at the working face by detecting the amount of earth or muck excavated or removed from the working face per unit time and the amount of earth or muck conveyed from the chamber per unit time, comparing these two detected values to generate an earth amount deviation signal representing the difference therebetween, controlling the amount of conveyed earth or muck and/or the amount of removed earth or muck in response to the earth amount deviation signal to maintain the earth pressure in the chamber within a predetermined range thereby ensuring stable tunnel boring operation without giving rise to breakdown of the exposed face or earth stratum and rising of the ground.

49 Claims, 6 Drawing Figures

CONTROL METHOD AND SYSTEM FOR ENSURING STABLE BORING OPERATION AT WORKING FACE DURING TUNNELLING WITH TUNNEL BORING OR SHIELD MACHINE

LIST OF PRIOR ART REFERENCES (37 CFR 1.56 (a))

The following reference is cited to show the state of the art:

Japanese Laying-open of Patent Application No. 51-732 (1976), "Method of Boring Tunnel by Shield Drive Technique."

This invention relates to methods and systems for controlling the earth pressure during boring tunnels with shield type tunnel boring machines, and more particularly to methods and systems for carrying out earth pressure control suitable for boring a tunnel in soft ground which is so soft as to easily breakdown and from which water exudes.

Figure 1B:
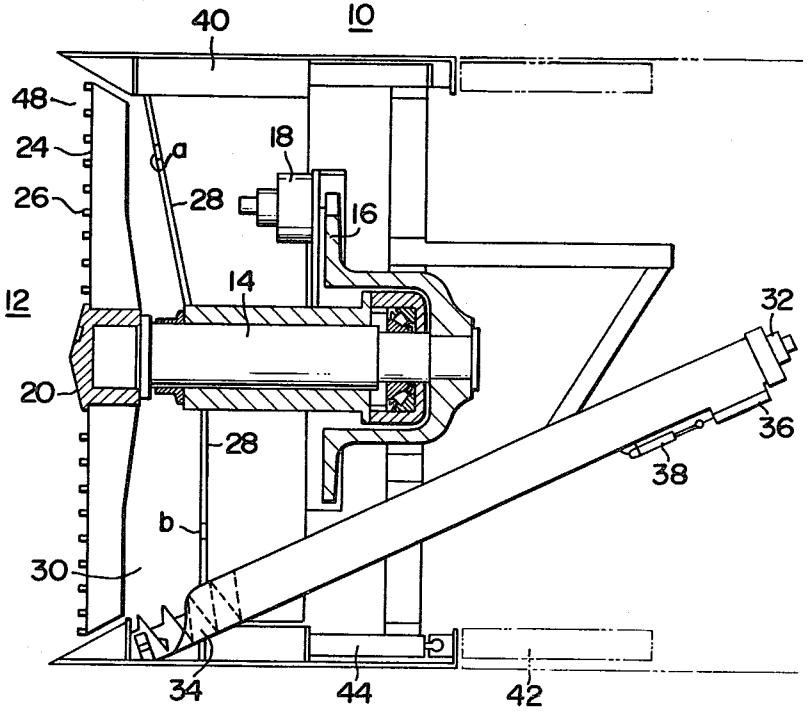
FIG. 1B is a schematic axial sectional view of the machine shown in FIG. 1A.

The necessity for boring tunnels in soft ground is increasing more and more for principal purposes of providing sewer systems in cities. Effective techniques for achieving these purposes are broadly classified into a so-called earth-pressure shield technique and a so-called slurry mole shield technique. These techniques will be briefly described with reference to the drawing. In the drawing, like reference numerals are used throughout to designate like parts.

Figure 1A:
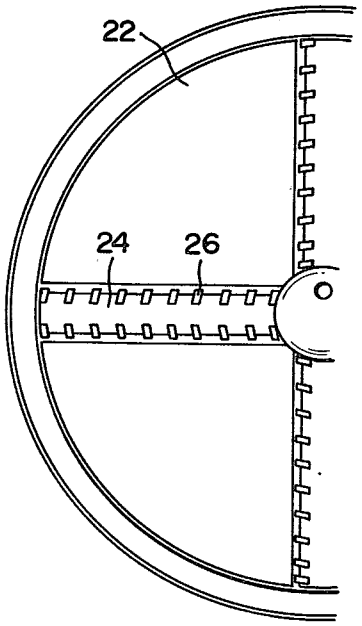
FIG. 1A is a schematic front elevational view of the left-hand portions only of a rotary cutter type tunnel boring machine to which the present invention is applied.

FIGS. 1A and 1B show a rotary cutter type tunnel boring machine or shield machine generally used for boring a tunnel according to the earth-pressure shield technique. FIG. 1A is a schematic front elevational view of the shield machine with its right-hand portions omitted, and FIG. 1B is a schematic axial sectional view of the machine shown in FIG. 1A.

Referring to FIGS. 1A and 1B, a cutter head 12 is disposed at the front end of the shield machine body 10 which is cylindrical in shape. The cutter head 12 is driven for rotation by a hydraulic motor 18 through a rotary shaft 14 and a transmission mechanism 16. The cutter head 12 is composed of a supporting member 20, a segmented face plate 22 securely fixed to the supporting member 20 for preventing breakdown of the exposed face, a plurality of rotary vanes 24 extending radially outwardly from the supporting member 20, and a multiplicity of cutter teeth 26 mounted in radially aligned relation on the front face of the rotary vanes 24. A bulkhead 28 is mounted in the machine frame immediately behind the cutter head 12, and a chamber 30 is defined between the cutter head 12 and the bulkhead 28. A rotary screw conveyor 34 is driven by a hydraulic motor 32 and has its front open end inserted into the chamber 30. A slide gate 36 is provided for discharging earth or muck conveyed by the screw conveyor 34 and is opened and closed by means of a hydraulic jack 38. A hood 40 is disposed along the circumference of the machine frame of the shield machine body 10 to be forced or driven toward and into a working face 48 by means of shield jacks 44 each of which is supported at one end by an earth-retaining concrete segment 42.

Figure 2B:
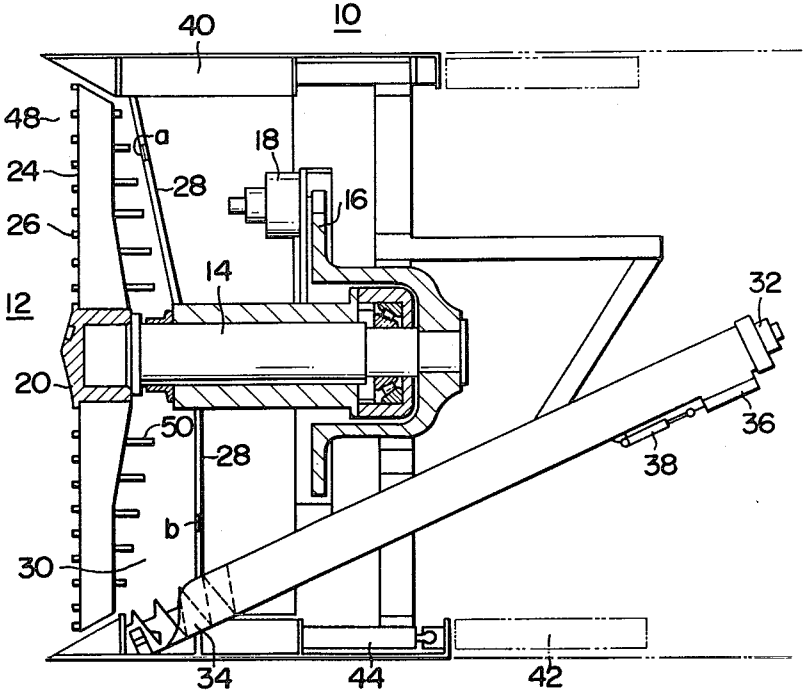
FIG. 2B is a schematic axial sectional view of the machine shown in FIG. 2A.
Figure 2A:
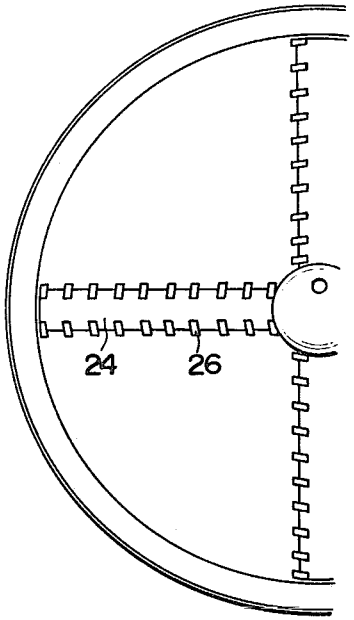
FIG. 2A is a schematic front elevational view of the left-hand portions only of another rotary cutter type tunnel boring machine to which the present invention is also applied.

In boring a tunnel with the shield machine of the type having the aforementioned construction, the cutter head 12 is rotated by the hydraulic motor 18 to remove earth or muck from the working face 48 with its cutter teeth 26. The removed earth or muck is accumulated at the working face 48 and in the chamber 30 and then conveyed from the chamber 30 into the shield machine body 10 by the screw conveyor 34. The earth is then discharged from the slide gate 36 to be transported to the exterior by a transporting means such as a truck. With the boring operation at the working face 48, the shield machine body 10 is advanced as the hood 40 is driven into the working face 48 by the force of the shield jacks 44. The intuition and experience of the operator is generally resorted to for preventing breakdown of the exposed face or earth stratum and rising of the ground. The operator prevents such an objectionable situation by controlling the hydraulic pressure of the shield jacks 44 driving the hood 40 or the hydraulic pressure of the motor 18 driving the cutter head 12, or he detects an abnormal state of the exposed face by roughly comparing the amount of removed earth with the amount of conveyed earth. The face plate 22 provided in the cutter head 12 acts also to mechanically prevent breakdown of the exposed face. Further, in a tunnel boring machine as disclosed in Japanese Laid-Open Patent Application No. 51-732 (1976) and as shown in FIGS. 2A and 2B, agitating vanes 50 are provided in the chamber 30 to impart an agitating action to the earth accumulating in the chamber 30. In the form shown in FIGS. 2A and 2B, a suitable soil nature adjusting agent such as an aqueous solution of bentonite is injected into the chamber 30 to be mixed with the excavated earth in the chamber 30 thereby turning the excavated earth into mud of high viscosity so that the earth pressure of such mud can be utilized for preventing breakdown of the exposed face. In the shield machine shown in FIGS. 2A and 2B, the face plate 22 in FIGS. 1A and 1B is eliminated. However, excellent intuition as well as rich experience is required for the operator since he manipulates the shield machine at the location where he cannot utterly see the state of the working face.

The principle of the slurry mole shield technique will next be described. According to this technique, slurry is supplied to the working face 48 and chamber 30 in FIGS. 1A to 2B by a slurry feed pipe from a slurry disposal plant or the like disposed on the ground to fill the working space with slurry, and the pressure of slurry is maintained within a predetermined range to prevent breakdown of the exposed face and exudation of slurry from the exposed face. However, essentially, resorting to the slurry pressure alone is not the fully effective means for the desired prevention of breakdown of the exposed face, and the face plate 22 in the cutter head 12 is also utilized for preventing breakdown of the exposed face. While this slurry mole shield technique is effective in boring a tunnel in soft ground, it requires various automatic control units including an automatic slurry pressure control unit, in addition to slurry disposal plant equipment including pipeing, pumps and a settling tank for supplying slurry into and discharging slurry from the shield machine. Thus, this technique is quite expensive considering the costs of the automatic control units and slurry disposal plant equipment occupying a wide ground space.

It is therefore a primary object of the present invention to provide a control method and system for ensuring stable boring operation at a working face during tunnelling with a tunnel boring or shield machine, which obviate the defects of the prior art earth-pressure shield technique and slurry mole shield technique, which can stably remove earth from the working face without giving rise to breakdown of the exposed face and rising of the ground, and which require costs lower than those required for the prior art slurry mole shield technique.

Another object of the present invention is to provide a control method and system of the above character, in which the amount of earth or muck conveyed from the chamber per unit time is maintained to be equal to the amount of earth muck removed from the working face per unit time to maintain the earth pressure in the chamber of the shield machine body within a predetermined range thereby ensuring stable boring operation at the working face.

Still another object of the present invention is to provide a control method and system of the above character, which ensure the safety and facility of tunnel boring operation by immediately automatically stopping the drive for the screw conveyor in the event of an accident such as unusual or dangerous flow-out of an excessive amount of earth or muck from the working face into the shield machine body.

A further object of the present invention is to provide a control method and system of the above character, in which the amount of earth or muck removed from the working face by the cutter head or the amount of earth or muck conveyed from the chamber by the screw conveyor is converted into an electrical signal to be displayed on a display unit such as a meter so that the amount of earth or muck excavated by the machine can be rationally controlled.

Figure 3:
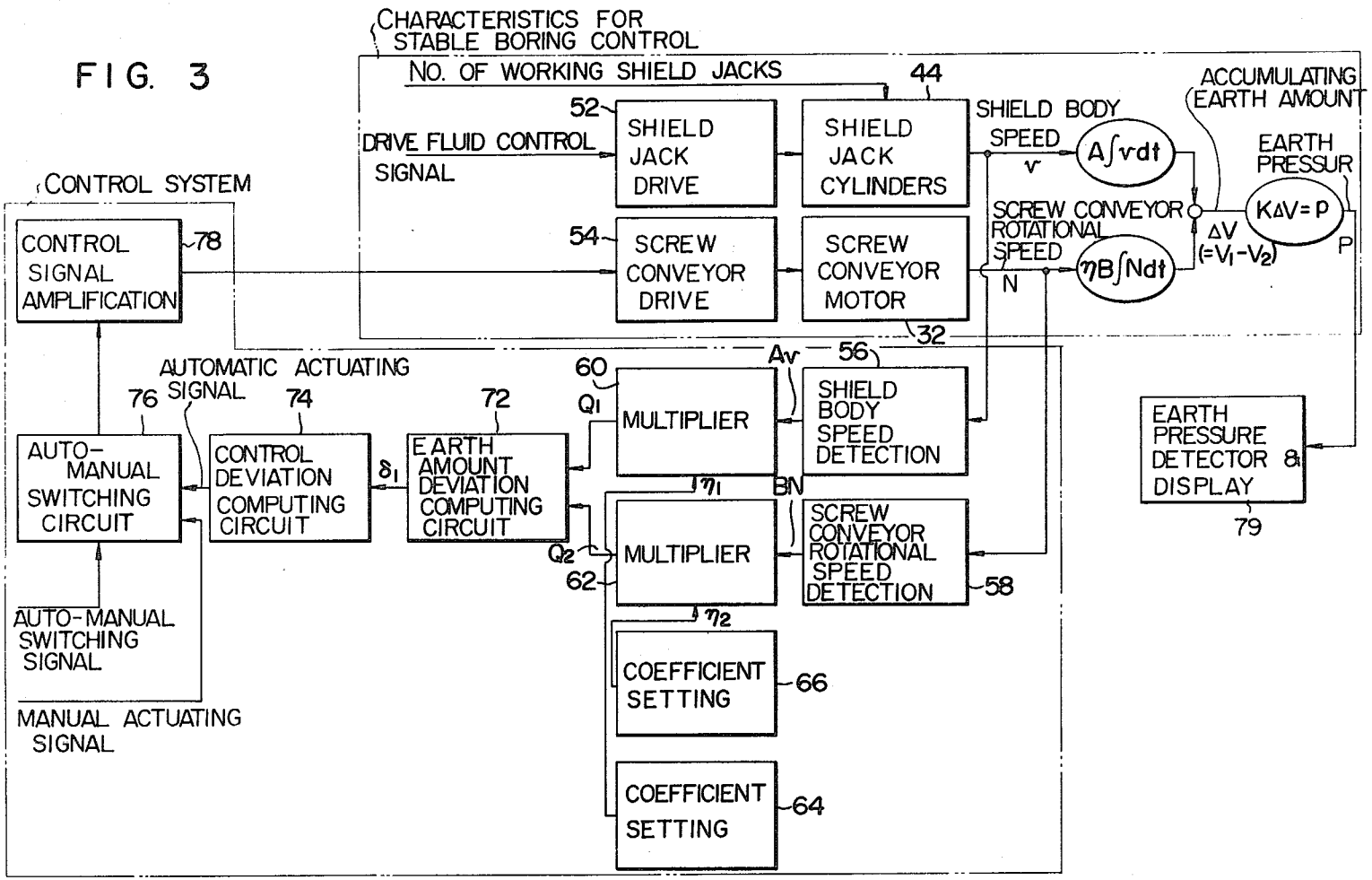
FIG. 3 is a diagram showing a control system for ensuring stable boring operation at working face according to an embodiment of the present invention.

An embodiment of the present invention will now be described in detail with reference to FIGS. 1A, 1B, 2A, 2B and 3. FIG. 3 shows various characteristics used for the stable boring operation at a working face during boring a tunnel with the shield machines shown in FIGS. 1A, 1B, 2A and 2B, and also shows one form of the control system used for the control according to the present invention. Numerical expressions of these characteristics will be discussed at first for a better understanding of the present invention.

A signal for controlling the flow rate of pressure fluid driving the shield jacks 44 is externally applied to a shield jack drive section 52 in FIG. 3 by, for example, manual operation by the operator. This control signal determines the output of the shield jack drive section 52. This output is used to control, for example, the amount of delivery of a hydraulic pump (not shown) to which the plural shield jacks 44 are connected in parallel. The number n of working shield jacks 44 and the moving speed of the shield jack cylinders are also externally determined. Consequently, the shield advancing speed or boring speed v of the shield machine body 10 is determined.

The amount $V_1$ of earth removed from the working face with the advancing movement of the shield machine body 10 is given by $$V_1 = A\int v\,dt \tag{1}$$

where A is the sectional area of the shield machine body 10. The term "amount of earth removed from the working face with the advancing movement of the shield machine body" is used to mean that the amount of excavated earth corresponds to the volume advanced by the shield machine body 10 during the above integration time.

An output corresponding to an input signal appears from a screw conveyor drive section 54 in FIG. 3. This output is applied to the hydraulic motor 32 driving the screw conveyor 34 to determine the rotating speed N of the screw conveyor 34. Thus, the amount $V_2$ of earth conveyed by the screw conveyor 34 is given by $$V_2 = \eta B\int N\,dt \tag{2}$$

where $\eta$ is the earth conveying efficiency of the screw conveyor 34 varying depending on the nature of soil, and B is the theoretical amount of earth conveyed per one revolution of the screw conveyor 34 and determined by the dimensions of the screw conveyor 34. When no face plate is provided as shown in FIGS. 2A and 2B, or when there is a face plate as shown in FIGS. 1A and 1B but the gap or slit between the face plate 22 and the rotary vanes 24 is sufficiently large to permit admission of substantially all the amount of excavated earth into the chamber 30, the amount $\Delta V$ of earth accumulating in the chamber 30 is given by $$\Delta V = V_1 - V_2 \tag{3}$$

Suppose that the equivalent modulus of volumetric elasticity of earth in the chamber 30 is K (which is determined by the factors including the nature of the soil and the rigidity of the exposed face), then the earth pressure P in the chamber 30 is expressed as $$P = K\Delta V. \tag{4}$$

When the gap or slit between the face plate 22 and the rotary vanes 24 in FIG. 1A is relatively narrow, it may sometimes be necessary to take into account the difference $\Delta P_S$ between the earth pressure at the working face 48 and that in the chamber 30, which difference is produced by the average flow of earth passing through the gap. In such a case, this earth pressure difference $\Delta P_S$ may be predicted, and the earth pressure P in the chamber 30 may be maintained at a value lower by $\Delta P_S$ than the earth pressure at the working face 48 so as to maintain an appropriate earth pressure acting upon the working face 48. Alternatively, the boring speed may be reduced to decrease the earth amount rate $dV_1/dt$ thereby maintaining $\Delta P_S$ at a practically negligible value. The above consideration has not any direct concern with the essence of the present invention, and therefore, any further detailed description will not be given herein.

The structure of the control system will now be described which ensures stable boring operation at the working face on the basis of the characteristics obtained as the result of the above analysis.

In order that a tunnel can be bored while ensuring stable boring operation at the working face, it is necessary to establish an equality between the amount of earth removed from the working face per unit time $dV_1/dt$ and the amount of earth conveyed by the screw conveyor per unit time $dV_2/dt$, thereby maintaining the pressure P of earth filling the chamber 30 at the value of static earth pressure at the exposed face to prevent breakdown of the exposed face. Practically, in the site of boring a tunnel, the amount of removed earth computed on the basis of the advancing movement of the shield machine body over the distance of one earth retaining segment ring is compared with the amount of actually conveyed earth to judge whether the shield machine is being driven through the exposed face while ensuring stable boring operation at the working face.

According to the basic concept of the control system of the present invention shown in FIG. 3, the earth amount rates $dV_1/dt$ and $dV_2/dt$ are compared to detect the deviation therebetween, and depending on whether this deviation is positive or negative, the propelling speed v of the shield jacks 44 and/or the rotating speed N of the screw conveyor 34 are controlled to satisfy the following relation:

$$\frac{dV_1}{dt} - \frac{dV_2}{dt} = 0 \tag{5}$$

The stucture and operation of the control system of the present invention will be described in greater detail with reference to FIG. 3. The advancing speed v of the shield machine body 10 is detected by a shield machine body speed detecting section 56 which includes, for example, a conventional meter measuring the stroke of the shield jacks 44. The detected advancing speed v is multiplied by the sectional area A of the shield machine body 10, and a signal representing the product A·v appears from speed detecting section 56. The rotating speed N of the screw conveyor 34 is detected by a screw conveyor rotating speed detecting section 58 which includes, for example, a conventional tachometer. The detected rotating speed N is multiplied by the theoretical amount B of earth conveyed per one revolution of the screw conveyor 34, and a signal representing the product B·N appears from the speed detecting section 58. These signals representing A·v and B·N are applied to a pair of multipliers 60 and 62 respectively. In the multiplier 60, the signal representing A·v is multiplied by a signal representing a coefficient $\eta_1$ to provide an output signal representing the theoretical amount $Q_1$ of earth removed per unit time. In the multiplier 62, the signal representing B·N is multiplied by a signal representing another coefficient $\eta_2$ to provide an output signal representing the theoretical amount $Q_2$ of earth conveyed per unit time. Thus, $Q_1$ and $Q_2$ are expressed as $$Q_1 = \eta_1 Av \tag{6}$$

$$Q_2 = \eta_2 BN \tag{7}$$

These coefficients $\eta_1$ and $\eta_2$ may be manually set in respective coefficient setting elements 64 and 66 shown in FIG. 3. However, it is preferable in the present invention to automatically set these coefficients $\eta_1$ and $\eta_2$ in respective servo-actuated coefficient setting elements 68 and 70 in dependence upon variation in the earth pressure P in the chamber 30, as will be described later with reference to FIG. 4.

The coefficients $\eta_1$ and $\eta_2$ may be set at constant values which are considered physically appropriate. Such a case will be described with reference to FIG. 3. The first coefficient $\eta_1$ which relates to the volume of removed earth is set at 1.0 assuming that the volume of earth removed from the working face is the same as the volume which the earth has occupied in the exposed face, or this coefficient $\eta_1$ is selected to have a value equal to the swell factor fs ($fs \geqq 1.0$) of earth liberated into the atmosphere from the compressed state in the exposed face. The second coefficient $\eta_2$ is selected to take a value equal to the earth conveying efficiency $\eta$ of the screw conveyor 34.

The amounts $Q_1$ and $Q_2$ computed in the manner above described correspond approximately to the amount of earth removed per unit time $dv_1/dt$ and the amount of earth conveyed per unit time $dv_2/dt$ respectively. The outputs of the multipliers 60 and 62 representing $Q_1$ and $Q_2$ respectively are applied to an earth amount deviation computing circuit 72 which provides an output signal representing the earth amount deviation $\delta_1$ given by $$\delta_1 = Q_1 - Q_2 = \eta_1 Av - \eta_2 BN \tag{8}$$

The signal representing this earth amount deviation $\delta_1$ is applied from the circuit 72 to a control deviation computing circuit 74 which provides a suitable control signal for controlling the screw conveyor 34 depending on the sign of $\delta_1$ and on the result of comparison with a reference value. For example, a reference value $\delta_0(\delta_0 > 00$ is previously set in the control deviation computing circuit 74, and this circuit 74 is constructed to provide a control signal for maintaining constant, increasing and decreasing the rotating speed N of the screw conveyor 34 when $-\delta_0 < \delta_1 < \delta_0$, $\delta_1 \geqq \delta_0$ and $\delta_1 \geqq -\delta_0$, respectively. The output of the control deviation computing circuit 74 is applied through an automatic-manual switching circuit 76 and a control signal amplifying section 78 to the screw conveyor drive section 54 to control the same. The automatic-manual switching circuit 76 acts to switch over from automatic operation to manual operation in response to an automatic-manual switching signal applied by the operator in the case in which the condition of soil cannot be covered by the above-mentioned automatic control system alone or in the event of unexpected failure of the control system. The control signal amplifying section 78 amplifies the output of the control deviation computing circuit 74 to a power level at which an actuator such as an electrically operated actuator can operate to electrically increase or decrease the amount of delivery of the hydraulic pump driving the screw conveyor 34. Thus, when the reference value $\delta_0$ is set at a very small value, the rotating speed N of the screw conveyor 34 can be controlled to increase and decrease when the value of $\delta_1$ is positive and negative respectively. It is therefore possible to carry out the tunnel boring operation while continuously maintaining the value of $\delta_1$ very close to zero, that is, maintaining the relation $Q_1 \approx Q_2$.

The above description has referred to the case in which the coefficients $\eta_1$ and $\eta_2$ supplied from the coefficient setting elements 64 and 66 to the multipliers 60 and 62 respectively are set at constant values. However, the set values of $\eta_1$ and $\eta_2$ may differ from the actual values encountered in the actual in the actual boring operation. In such a case, $dV_1/dt$ will not be equal to $dV_2/dt$ or $(dV_1/dt) \neq (dV_2/dt)$ in the actual operation of the control system although the relation $Q_1 = Q_2$ would hold from the standpoint of computation. Thus, in such a case, an increase or decrease in the amount of earth accumulating in the chamber 30 will occur in a certain period of time resulting in the corresponding variation in the earth pressure P in the chamber 30, and the desired control for ensuring stable boring operation at the working face will not be attained in a strict sense. However, a constant earth pressure need not necessarily be established in the chamber 30 when carrying out boring operation through a self-supporting working face. In such a specific case, the values of $\eta_1$ and $\eta_2$ may be determined on the basis of past experiences or the result of tests conducted in the same site, and the control system may operate simply as a synchronized system, so that the screw conveyor 34 may merely convey the amount $V_2$ equal to the amount $V_1$ of removed earth. Further, the detected earth pressure P in the chamber 30 may be displayed on a display element 79 such as an analog or digital meter, and the coefficient setting elements 64 and 66 may be manually regulated to vary the settings of $\eta_1$ and $\eta_2$ depending upon the displayed earth pressure so as to achieve control which is more stable than hitherto.

Figure 4:
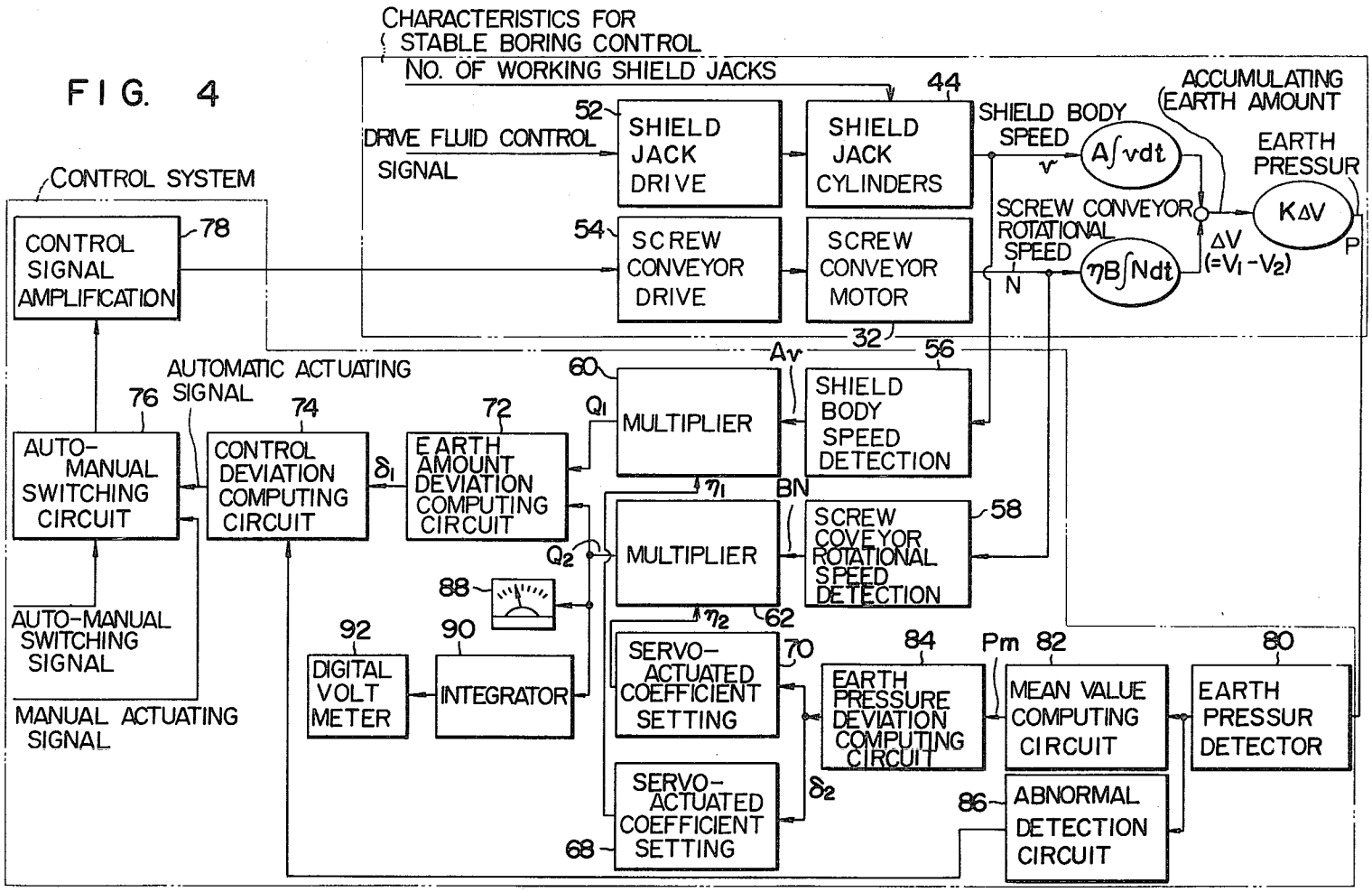
FIG. 4 is a diagram showing a control system for ensuring stable boring operation at working face according to another embodiment of the present invention.

In boring a tunnel in soft ground, however, it is considered most suitable for the stable boring through the working face to automatically vary the values of the coefficients $\eta_1$ and $\eta_2$ and to control the earth pressure P in the chamber 30 to within an appropriate range corresponding to the static earth pressure at the exposed face in order to prevent breakdown of the exposed face. This control method will be described in detail with reference to FIG. 4. In FIG. 4, the same or like reference numerals are used to denote the same or like blocks shown in FIG. 3.

The actual earth pressure P in the chamber 30 cannot be computed from the formulas obtained as the result of the above analysis because such factors as $\eta$ and K are both very difficult to be pre-estimated. Earth pressure meters 80 are mounted on the bulkhead 28 at a plurality of locations as indicated by the symbols a and b in FIGS. 1B and 2B to detect the earth pressures P in these portions of the chamber 30. The detected earth pressure values are then averaged to average the noise and peak values, or suitable weights are applied to the outputs of the earth pressure meters 80 to average the detected earth pressure values depending on the locations of the earth pressure meters 80. This averaging is performed in a mean value computing circuit 82, and an output signal representing the mean earth pressure $P_m$ appears from the mean value computing circuit 82 to be applied to an earth pressure deviation computing circuit 84. The earth pressure deviation computing circuit 84 delivers an output signal representing the earth pressure deviation $\delta_2$ provided by the difference $(P_m - P_s)$ between the mean earth pressure $P_m$ and a constant value $P_s$ determined on the basis of the preset static earth pressure at the exposed face, or the differentiated value $dP_m/dt$ of the mean earth pressure $P_m$, or their sum $(dP_m/dt) + (P_m - P_s)$. It is also effective to directly compute $\delta_2$ on the basis of the detected earth pressures P in lieu of the mean earth pressure $P_m$. The earth pressure deviation signal $\delta_2$ is applied from the circuit 84 to a pair of servo-actuated coefficient setting elements 68 and 70. The servo-actuated coefficient setting element 68 is arranged so that the value of the coefficient $\eta_1$ applied to the multiplier 60 can be automatically set relative to variation in the value of the input $S_2$, and this element 68 may be changed over to manually set the value of the coefficient $\eta_1$. In the case of the automatic setting, the output $\eta_1$ takes a positive value always. In the case the input $\delta_2$ is zero $\eta_1$ is kept constant and in the case the input $\delta_2$ is positive or negative $\eta 1$ increases or decreases at a predetermined rate respectively. The servo-actuated coefficient setting element is similar to the servo-actuated coefficient setting element 68 in that it acts to automatically and manually set the coefficient $\eta_2$ applied to the multiplier 62. However, the element 70 differs in function from the element 68 in that the output $\eta_2$ decreases or increases at a predetermined rate when the input $\delta_2$ is positive or negative. The rates of variation of the coefficients $\eta_1$ and $\eta_2$, when the input $\delta_2$ is not zero must be selected to be relatively small so as to deal with the delayed response of the control loop where the earth pressure P in the chamber 30 is first detected, the amount of earth conveyed per unit time $dV_2/dt$ is then increased or decreased depending on the detected variation in the earth pressure P in the chamber 30 is changed depending on the variation of the earth amount rate $dV_1/dt$. This is because, otherwise, hunting tends to occur in the entire control system.

Either or both of the coefficients $\eta_1$ and $\eta_2$ are automatically set depending on the variation in the earth pressure P in the chamber 30 in the manner above described so that the desired stable control of boring operation at the working face in a true sense can be achieved to establish both the relation $Q_1 = Q_2$ and the relation $(dV_1/dt) = (dV_2/dt)$ in the actual system. Thus, the control loop is completed which comprises the steps of detection of the earth pressure P in the chamber 30→generation of the control signal→control of the rotating speed N of the screw conveyor 34 or the propelling speed v of the shield jacks 44→correction of the earth pressure P in the chamber 30.

In the control system shown in FIG. 4, there are three cases for setting the values of the coefficients $\eta_1$ and $\eta_2$. In the first case, the coefficient $\eta_1$ is manually set at a constant value, and the coefficient $\eta_2$ is made automatically variable to follow the variation in the earth pressure deviation $\delta_2$. In the second case, the coefficient $\eta_2$ is set at a constant value, and the coefficient $\eta_1$ is made variable to follow the variation in the earth pressure deviation $\delta_2$. In the third case, both the coefficients $\eta_1$ and $\eta_2$ is made automatically variable to follow the variation in the earth pressure deviation $\delta_2$. The operation of the control system will be described with particular reference to the first case in which the coefficient $\eta_1$ is especially set at 1.0.

At first, the coefficient $\eta_1$ is manually set at the constant value of $\eta_1 = 1.0$, and the coefficient $\eta_2$ is made automatically variable to follow the variation in the earth pressure deviation $\delta_2$. The coefficient $\eta_1$ can be considered to be $\eta_1 = 1.0$ as far as the volume of earth under the preset static earth pressure at the exposed face is taken as a basis, while the coefficient $\eta_2$ which is approximately equal to the earth conveying efficiency $\eta$ of the screw conveyor 34 is variable depending on the nature of soil and on the earth pressure.

(i) $Q_1 = Av = dV_1/dt$ since $\eta_1 = 1.0$ (ii) $Q_2 = \eta BN = dV_2/dt$ assuming that $\eta_2 = \eta$.

(iii) The earth amount deviation $\delta_1$ is given by $$\delta_1 = Q_1 - Q_2 = \frac{dV_1}{dt} - \frac{dV_2}{dt}$$

$$= \frac{d(V_1 - V_2)}{dt} = \frac{d}{dt}(\Delta V)$$

Thus, the earth amount deviation $\delta_1$ represents the amount d/dt ($\Delta$V) of earth actually remaining in the chamber 30 per unit time.

(iv) The control system controls the screw conveyor drive section 54 to reduce this $\delta_1$ to zero thereby maintaining the relation $Q_1=Q_2$.

(v) However, $Q_2 \neq dV_2/dt$ when $\eta_2 \neq \eta$. In such a case, $(dV_1/dt) \neq (dV_2/dt)$, and d/dt ($\Delta$V) is not zero although the relation $Q_1=Q_2$ holds according to the computation in the control system.

(vi) The earth pressure P in the chamber 30 is given by $$P = K\Delta V = K(V_1 - V_2)$$

and its differentiated value dP/dt is $$\frac{dP}{dt} = K\frac{d}{dt}(\Delta V) = K\left(\frac{dV_1}{dt} - \frac{dV_2}{dt}\right) \neq 0$$

This means that the earth pressure P in the chamber 30 increases or decreases.

(vii) The earth pressure deviation computing circuit 84 produces the output signal representing the earth pressure deviation $\delta_2 = P_m - P_s$, or $\delta_2 = dP_m/dt$, or $\delta_2 = (P_m - P_s) + (dP_m/dt)$, and the value of the coefficient $\eta_2$ is decreased or increased depending on whether this earth pressure deviation $\delta_2$ is positive or negative.

(viii) Thus, there exists the relation $(dV_1/dt) > (dV_2/dt)$ when $\delta_2 > 0$, in spite of the fact that the relation $Q_1=Q_2$ holds in computation. Therefore, considering the equation $Q_1 = dV_1/dt$, the relation $Q_2 > dV_2/dt$ holds now, and $\eta_2$ is larger than $\eta$ or $\eta_2 > \eta$. The servo-actuated coefficient setting element 70 acts now to decrease the setting of $\eta_2$. In an entirely contrary case in which $\delta_2 < 0$, the relation $Q_2 < dV_2/dt$ holds, and $\eta_2$ is smaller than $\eta$ or $\eta_2 < \eta$. The servo-actuated coefficient setting element 70 acts now to increase the setting of $\eta_2$.

(ix) As a result, the control system operates to re-establish the relation $Q_1=Q_2$ for the new setting of $\eta_2$, so that the rotating speed N of the screw conveyor 34 is increased or decreased depending on whether the value of $\delta_2$ is positive or negative respectively.

(x) Finally, a balance is reached between the amount of removed earth and the amount of conveyed earth when the earth amount deviation $\delta_1=0$, that is, at the point at which the mean earth pressure $P_m$ in the chamber 30 is maintained constant.

(xi) Thus, the relation $dV_1/dt = dV_2/dt$ holds, and the desired control for ensuring stable boring operation at the working face can be achieved in a true sense.

The above description has specifically referred to the first case in which the coefficient $\eta_1$ is set at a constant value of 1.0, while the coefficient $\eta_2$ is made automatically variable. It is apparent that the relation $(dV_1/dt) = (dV_2/dt)$ can also be established in a substantially similar manner in the remaining cases. It will be appreciated that the control system according to the present invention is primarily constructed to maintain the relation $Q_1=Q_2$ at whatever values of $\eta_1$ and $\eta_2$. The operation of the control system is such that the sign of the earth pressure deviation $\delta_2$ is determined depending on the relative magnitudes of $dV_1/dt$ and $dV_2/dt$, and the coefficients $\eta_1$ and $\eta_2$ are changed to new values depending on the sign of the earth pressure deviation $\delta_2$ so that these new settings of $\eta_1$ and $\eta_2$ can be used to re-establish the relation $Q_1=Q_2$. Such operation continues until finally the earth amount deviation $\delta_1$ is reduced to zero, that is, until the relation $dV_1/dt = dV_2/dt$ holds again. Thus, either $\eta_1$ or $\eta_2$ may be made variable to maintain the relations $Q_1=Q_2$ and $(dV_1/dt) = (dV_2/dt$. However, the manner of control with the variable coefficient $\eta_1$ differs from that with the variable coefficient $\eta_2$ in that $\eta_1$ is increased or decreased depending on whether the earth pressure deviation $\delta_2$ is positive or negative in the former case, while $\eta_2$ is decreased or increased depending on whether $\delta_2$ is positive or negative in the latter case.

The amounts $Q_1$ and $Q_2$ have different meanings depending on whether $\eta_1$ or $\eta_2$ is made variable. From this standpoint, the three cases described hereinbefore will be individually discussed.

(1) In the first case, the coefficient $\eta_1$ is set at a constant value, while the coefficient $\eta_2$ is made automatically variable.

(a) $\eta_1 = 1.0$

When a balance is reached between the amount of removed earth and the amount of conveyed earth, the equations $Q_1 = dV_1/dt$ and $Q_2 = dV_2/dt$ hold. The amounts $Q_1$ and $Q_2$ represent respectively the amounts of earth removed and conveyed per unit time when the volume of earth under the static earth pressure at the exposed face is taken as a basis. The volume of earth actually liberated into the atmosphere is computed by multiplying the amount by the swell factor fs of earth. On the other hand, the coefficient $\eta_2$ is approximately equal to the earth conveying efficiency $\eta$ of the screw conveyor 34.

(b) $\eta_1 =$ fs

When a balance is reached between the amount of removed earth and the amount of conveyed earth, the relations $Q_1=Q_2$ and $(dV_1/dt) = (dV_2/dt)$ hold. These amounts $Q_1$ and $Q_2$ are expressed respectively as $Q_1 = \eta_1 Av = fsAv = fs(dV_1/dt)$, and $Q_2 = \eta_2 BN = fs(dV_2/dt)$. Thus, $Q_1$ and $Q_2$ are each based on the volume of earth liberated into the atmosphere, and the coefficient $\eta_2$ in this case is approximately equal to fs $\eta$.

(2) In the second case, the coefficient $\eta_2$ is set at a constant value, while the coefficient $\eta_1$ is made automatically variable.

The coefficient $\eta_2$ is set at an estimated mean value of the earth conveying efficiency $\eta$ of the screw conveyor 34. When $\eta_2$ is set at such a value, the equation $Q_2 = dv_2/dt$ does not hold always since $\eta_2$ in the equation $Q_2 = \eta_2 BN$ is not always equal to the actual efficiency. Even when $\eta_2 \neq \eta$, however, the value of the coefficient $\eta_1$ is suitably varied to maintain the relations $Q_1=Q_2$ and $(dV_1/dt) = (dV_2/dt)$. The equation $Q_1 = dV_1/dt$ does not also hold always.

(3) In the third case, both the coefficients $\eta_1$ and $\eta_2$ are made automatically variable.

In this third case, it is necessary to maintain a predetermined relationship between the rates of variation of $\eta_1$ and $\eta_2$ relative to the variation in the earth amount deviation $\delta_1$. In this case too, the equations $Q_1=dV_1/dt$ and $Q_2=dV_2/dt$ do not hold always although the relations $Q_1=Q_2$ and $(dV_1/dt)=(dV_2/dt)$ are maintained.

It will be seen from the above discussion that the desired control for stable boring operation at the working face can be achieved in each of the three cases in which the coefficients $\eta_1$ and $\eta_2$ are selected in the manner described. The amounts $Q_1$ and $Q_2$ have their distinct meanings in (1) (*a*) and (1) (*b*), so that the setting of $\eta_1$ and $\eta_2$ of these cases is rational and most desirable. In these cases, $Q_2$ is equal to $dV_2/dt$ or $fs(dV_2/dt)$ representing the amount of earth conveyed per unit time. Thus, as shown in FIG. 4, this amount $Q_2$ may be displayed on an analog meter 88 or on a digital volt meter 92 through an integrator 90. Rational control of conveyed earth can therefore be achieved. Similar effects can be obtained when $Q_1$ is displayed on the meters 88 and 92 in lieu of $Q_2$. This display is naturally applicable also to the embodiment shown in FIG. 3.

It will thus be understood that, by the use of the control system of the present invention shown in FIG. 4, tunnel boring operation can be safely carried out while maintaining a balance between the amount of earth removed per unit time and the amount of earth conveyed per unit time and while holding the earth pressure P in the chamber 30 within an appropriate range which does not give rise to breakdown of the exposed face and rising of the ground. The amount of earth conveyed by the screw conveyor 34 can be controlled automatically so that the shield machine can be operated more easily than hitherto, and the reliability can also be improved. Referring to FIG. 4, an abnormal state detecting circuit 86 is connected between the control deviation computing circuit 74 and one of the earth pressure meters 80. This specific earth pressure meter 80 is mounted on the bulkhead 28 at the location (for example, that indicated by the symbol a in FIGS. 1B and 2B) capable of immediately detecting breakdown of the working face, among the plural earth pressure meters 80 located in the chamber 30. The abnormal state detecting circuit 86 detects the output of the specific earth pressure meter 80 and acts to immediately stop the operation of the screw conveyor 34 or generate a signal instructing the closure of the slide gate 36 in FIGS. 1B and 2B, when the output of the specific earth pressure meter 80 becomes zero or an allowable minimum. The circuit 86 may detect failure of the earth pressure meter or meters 80 by detecting inconsistency between the outputs of the plural earth pressure meters 80. The automatic-manual switching circuit 76 acts to switch over from automatic operation to manual operation in response to an automatic-manual switching signal applied by the operator in the case in which the condition of soil cannot be covered by the above-mentioned automatic control system alone or in the event of unexpected failure of the control system.

The foregoing description has referred to applications of the present invention to tunnel boring machines having screw conveyors as shown in FIGS. 1A, 1B, 2A and 2B. This invention is also applicable to a tunnel boring machine of the kind having an earth or muck conveying means capable of regulating the amount of conveyed earth from zero to a maximum. The earth pressure P in the chamber 30 can also be maintained within an appropriate range by applying the control signal from the control system to the shield jack drive section 52 in lieu of the screw conveyor drive section 54 thereby automatically controlling the advancing speed of the shield machine body 10. In such a case, it is necessary to connect the control system with the shield jack drive section 52 so that the propelling speed of the shield jacks 44 can be decreased with an increase in the earth amount deviation $\delta_1$.

In addition to its applications to the aforementioned rotary cutter type tunnel boring machines, the present invention is also applicable to a blind type tunnel boring machine which bores a tunnel by merely propelling a shield machine body into a working face, and is also applicable to a tunnel boring machine having a boring tool except the rotary cutter. In such applications too, the amount of earth removed per unit time and the amount of earth conveyed per unit time are completely balanced to maintain an appropriate earth pressure in a chamber defined between a working face and a bulkhead mounted in the machine frame of the shield machine body thereby ensuring stable boring operation at the working face.

The present invention described in detail hereinbefore provides the following advantages:

(1) A tunnel can be bored in soft ground while reliably preventing breakdown of the exposed face and rising of the ground.

(2) Automatic control of the machine operation facilitates the boring operation and improves the reliability.

(3) The ground installations and ground area are far less than those required for the slurry mole shield technique, thereby remarkably reducing the equipment and running costs.

(4) The amount of earth excavated by the shield machine or the amount of earth conveyed by the screw conveyor is converted into an electrical signal to be displayed on an analog or digital meter. Thus, rational earth amount control can be achieved.

While the present invention has been described with reference to the detection of the earth pressure in the chamber by means of earth pressure meters, the notable advantages of the present invention remain the same when, for example, stress, deformation or displacement of a constructive member of the shield machine is measured to detect the thrust imparted to the shaft of the cutter head, so that the earth pressure in the chamber can be controlled depending on the detected value.

What I claim is

1. In a tunnel boring or shield machine of the earth-pressure control type including a chamber defined between a working face and a bulkhead mounted in a machine frame of a shield machine body, means for controlling the amount of earth or muck conveyed to the exterior from said chamber in which earth or muck is accumulated, and drive means for propelling the shield machine body toward and into the working face, an earth-pressure control method for ensuring stable boring operation at the working face and comprising the steps of:

detecting the amount of earth or muck removed per unit time from said working face with the advancing movement of said shield machine body;

detecting the amount of earth or muck conveyed per unit time from said chamber by the conveying operation of said conveyed earth amount control means;

comparing the detected amount of earth or muck removed per unit time with the detected amount of earth or muck conveyed per unit time thereby producing a signal representing the earth amount deviation provided by the difference therebetween; and maintaining the earth pressure of the earth or muck filling said chamber within a predetermined range which does not give rise to breakdown of the exposed earth and rising of the ground by controlling at least one of the amount of removed earth or muck and the amount of conveyed earth or muck in response to said earth amount deviation signal.

2. A control method as claimed in claim 1, wherein said amount of earth or muck removed per unit time is computed on the basis of the advancing speed of said shield machine body, said conveyed earth amount control means including a screw conveyor, and said amount of earth or muck conveyed per unit time is computed on the basis of the rotating speed of said screw conveyor.

3. A control method as claimed in claim 2, wherein said step of detecting said amount of earth or muck removed per unit time includes the steps of detecting the advancing speed v of said shield machine body, multiplying the detected advancing speed v of said shield machine body by the sectional area A of said shield machine body to obtain the product A·v, and multiplying the product A·v by a first coefficient $\eta_1$ of a predetermined value to compute the theoretical amount $Q_1$ of earth or muck removed per unit time given by $Q_1=\eta_1 Av$; and said step of detecting said amount of earth or muck conveyed per unit time includes the steps of detecting the rotating speed N of said screw conveyor, multiplying the detected rotating speed N of said screw conveyor by the theoretical amount B of earth or muck conveyed per one revolution of said screw conveyor to obtain the product B·N, and multiplying the product B·N by a second coefficient $\eta_2$ of a predetermined value to compute the theoretical amount $Q_2$ of earth or muck conveyed per unit time given by $Q_2=\eta_2 BN$.

4. A control method as claimed in claim 3, wherein said first coefficient $\eta_1$ is a coefficient relating to the volume of removed earth or muck and is selected to be 1.0 assuming that earth or muck removed from said working face retains the state it has taken in the exposed face, and said second coefficient $\eta_2$ is selected to be equal to the earth conveying efficiency $\eta$ of said screw conveyor varying depending on the nature of soil.

5. In a tunnel boring or shield machine including a chamber defined between a working face and a bulkhead mounted in a machine frame of a shield machine body, means for controlling the amount of earth or muck conveyed to the exterior from said chamber in which earth or muck is accumulated, and drive means for propelling the shield machine body toward and into the working face, an earth-pressure control method for ensuring stable boring operation at the working face and comprising the steps of:

detecting the amount of earth or muck removed per unit time from said working face with the advancing movement of said shield machine body;

detecting the amount of earth or muck conveyed per unit time from said chamber by the conveying operation of said conveyed earth amount control means;

comparing the detected amount of earth or muck removed per unit time with the detected amount of earth or muck conveyed per unit time thereby producing a signal representing the earth amount deviation provided by the difference therebetween; and controlling at least one of the amount of removed earth or muck and the amount of conveyed earth or muck in response to said earth amount deviation signal to maintain the earth pressure in said chamber within a predetermined range which does not give rise to breakdown of the exposed earth and rising of the ground wherein said amount of earth or muck removed per unit time is computed on the basis of the advancing speed of said shield machine body, said conveyed earth amount control means including a screw conveyor, and said amount of earth or muck conveyed per unit time is computed on the basis of the rotating speed of said screw conveyor, wherein said step of detecting said amount of earth or muck removed per unit time includes the steps of detecting the advancing speed v of said shield machine body, multiplying the detected advancing speed v of said shield machine body by the sectional area A of said shield machine body to obtain the product A·v, and multiplying the product A·v by a first coefficient $\eta_1$ of a predetermined value to compute the theoretical amount $Q_1$ of earth or muck removed per unit time given by $Q_1=\eta_1 Av$; and said step of detecting said amount of earth or muck conveyed per unit time includes the steps of detecting the rotating speed N of said screw conveyor, multiplying the detected rotating speed N of said screw conveyor by the theoretical amount B of earth or muck conveyed per one revolution of said screw conveyor to obtain the product B·N, and multiplying the product B·N by a second coefficient $\eta_2$ of a predetermined value to compute the theoretical amount $Q_2$ of earth or muck conveyed per unit time given by $Q_2=\eta_2 BN$, and wherein said first coefficient $\eta_1$ is a coefficient relating to the volume of removed earth and is selected to be equal to the swell factor fs ($fs \geqq 1.0$) of earth liberated into the atmosphere from the exposed face, and said second coefficient $\eta_2$ is selected to be equal to $fs \cdot \eta$ where $\eta$ is the earth conveying efficiency of said screw conveyor varying depending on the nature of soil.

6. A control method as claimed in claim 1, further comprising the step of comparing said earth amount deviation with a predetermined reference value to produce a control signal representing the result of comparison and controlling at least one of said amount of removed earth and said amount of conveyed earth in response to said control signal thereby maintaining the earth pressure in said chamber within a predetermined range which does not give rise to breakdown of the exposed face and rising of the ground.

7. A control method as claimed in claim 3, wherein said earth amont deviation $\delta_1$ is given by $$\delta_1=Q_1-Q_2,$$

and said method further comprises the step of comparing $\delta_1$ with a reference value $\delta_0(\delta_0>0)$ to produce a control signal representing the result of comparison and controlling at least one of said amount of removed earth and said amount of conveyed earth in response to said control signal thereby maintaining the earth pressure in said chamber within a predetermined range which does not give rise to breakdown of the exposed face and rising of the ground.

8. A control method as claimed in claim 7, wherein said control signal is selected so as to maintain the rotating speed N of said screw conveyor constant when $\delta_1$ satisfies the relation $-\delta_0<\delta_1<\delta_0$, to increase the rotating speed N when $\delta_1$ satisfies the relation $\delta_1 \geqq \delta_0$, and to decrease the rotating speed N when $\delta_1$ satisfies the relation $\delta_1 \geqq -\delta_0$.

9. A control method as claimed in claim 7, wherein said control signal is selected so as to maintain the propelling speed v of said shield machine body constant when $\delta_1$ satisfies the relation $-\delta_0<\delta_1<\delta_0$, to decrease the propelling speed v when $\delta_1$ satisfies the relation $\delta_1 \geqq \delta_0$, and to increase the propelling speed v when $\delta_1$ satisfies the relation $\delta_1 \geqq -\delta_0$.

10. In a tunnel boring or shield machine including a chamber defined between a working face and a bulkhead mounted in a machine frame of a shield machine body, means for controlling the amount of earth or muck conveyed to the exterior from said chamber in which earth or much is accumulated, and drive means for propelling the shield machine body toward and into the working face, an earth pressure control method for ensuring stable boring operation at the working face and comprising the steps of:

detecting the amount of earth or muck removed per unit time from said working face with the advancing movement of said shield machine body;

detecting the amount of earth or muck conveyed per unit time from said chamber by the conveying operation of said conveyed earth amount control means;

comparing the detected amount of earth or muck removed per unit time with the detected amount of earth or muck conveyed per unit time thereby producing a signal representing the earth amount deviation provided by the difference therebetween; and controlling at least one of the amount of removed earth or muck and the amount of conveyed earth or muck in response to said earth amount deviation signal to maintain the earth pressure in said chamber within a predetermined range which does not give rise to breakdown of the exposed earth and rising of the ground, wherein said amount of earth or muck removed per unit time is computed on the basis of the advancing speed of said shield machine body, said conveyed earth amount control means including a screw conveyor, and said amount of earth or muck conveyed per unit time is computed on the basis of the rotating speed of said screw conveyor;

wherein said step of detecting said amount of earth or muck removed per unit time includes the steps of detecting the advancing speed v of said shield machine body, multiplying the detected advancing speed v of said shield machine body by the sectional area A of said shield machine body to obtain the product A·v, and multiplying the product A·v by a first coefficient $\eta_1$ of a predetermined value to compute the theoretical amount $Q_1$ of earth or muck removed per unit time given by $A_1=\eta_1 Av$; and said step of detecting said amount of earth or muck conveyed per unit time includes the steps of detecting the rotating speed N of said screw conveyor multiplying the detected rotating speed N of said screw conveyor by the theoretical amount B of earth or muck conveyed per one revolution of said screw conveyor to obtain the product B·N and multiplying the product B·N by a second coefficient $\eta_2$ of a predetermined value to compute the theoretical amount $Q_2$ of earth or muck conveyed per unit time given by $Q_2=\eta_2 BN$, and further comprising the steps of:

detecting the earth pressure in said chamber displaying the detected earth pressure; and setting at least one of said first and second coefficients $\eta_1$ and $\eta_2$ on the basis of the displayed earth pressure value.

11. In a tunnel boring or shield machine including a chamber defined between a working face and a bulkhead mounted in a machine frame of a shield machine body, means for controlling the amount of earth or muck conveyed to the exterior from said chamber in which earth or muck is accumulated, and drive means for propelling the shield machine body toward and into the working face, an earth-pressure control method for ensuring stable boring operation at the working face and comprising the steps of:

detecting the amount of earth or muck removed per unit time from said working face with the advancing movement of said shield machine body;

detecting the amount of earth or muck conveyed per unit time from said chamber by the conveying operation of said conveyed earth amount control means;

comparing the detected amount of earth or muck removed per unit time with the detected amount of earth or muck conveyed per unit time thereby producing a signal representing the earth amount deviation provided by the difference therebetween; and controlling at least one of the amount of removed earth or muck and the amount of conveyed earth or muck in response to said earth amount deviation signal to maintain the earth pressure in said chamber within a predetermined range which does not give rise to breakdown of the exposed earth and rising of the ground, wherein said amount of earth or muck removed per unit time is computed on the basis of the advancing speed of said shield machine body, said conveyed earth amount control means including a screw conveyor, and said amount of earth or muck conveyed per unit time is computed on the basis of the rotating speed of said screw conveyor, wherein said step of detecting said amount of earth or muck removed per unit time includes the steps of detecting the advancing speed v of said shield machine body, multiplying the detected advancing speed v of said shield machine body by the sectional area A of said shield machine body to obtain the product A·v, and multiplying the product A·v by a first coefficient $\eta_1$ of a predetermined value to compute the theoretical amount $Q_1$ of earth or muck removed per unit time given by $Q_1=\eta_1 Av$; and said step of detecting said amount of earth or muck conveyed per unit time includes the steps of detecting the rotating speed N of said screw conveyor, multiplying the detected rotating speed N of said screw conveyor by the theoretical amount B of earth or muck conveyed per one revolution of said screw conveyor to obtain the product B·N and multiplying the product B·N by a second coefficient $\eta_2$ of a predetermined value to compute the theoretical amount $Q_2$ of earth or muck conveyed per unit time given by $Q_2=\eta_2 BN$ and further comprising the steps of:

detecting the earth pressure P in said chamber to produce a signal representing the detected earth pressure in said chamber;

comparing the detected earth pressure in said chamber provided by said chamber earth pressure signal with a reference value $P_s$ determined previously on the basis of the static earth pressure at the exposed face to produce a signal representing the earth pressure deviation $\delta_2$ provided by the result of comparison; and varying at least one of said first and second coefficientts$\eta_1$ and $\eta_2$ depending on the level of said earth pressure deviation signal $\delta_2$.

12. A control method as claimed in claim 11, wherein the rate of variation of said first and second coefficients $\eta_1$ and $\eta_2$ varying depending on the level of said earth pressure deviation signal $\delta_2$ is less than a predetermined rate.

13. A control method as claimed in claim 11, wherein the signal representing the detected earth pressure value P in said chamber is directly produced as said chamber earth pressure signal in said earth pressure signal producing step.

14. A control method as claimed in claim 11, wherein said earth pressure signal producing step further includes the step of averaging the detected earth pressure value P to obtain a mean earth pressure value $P_m$, and a signal representing said mean earth pressure value $P_m$ is produced as said chamber earth pressure signal.

15. The control method as claimed in claim 11, wherein said earth pressure signal producing step further includes the steps of averaging the detected earth pressure value P to obtain a mean earth pressure value $P_m$, and differentiating said mean earth pressure value $P_m$ to obtain its differentiated value $dP_m/dt$, and a signal representing $dP_m/dt$ is produced as said chamber earth ) pressure signal.

16. A control method as claimed in claim 11, wherein said earth pressure signal producing step further includes the steps of averaging the detected earth pressure value P to obtain a mean earth pressure value $P_m$, and differentiating said mean earth pressure value $P_m$ to obtain its differentiated value $dP_m/dt$, and a signal representing the sum $P_m+(dP_m/dt$ is produded as said chamber earth pressure signal.

17. A control method as claimed in claim 11, wherein said first coefficient $\eta_1$ is a coefficient relating to the volume of removed earth or muck and is selected to be 1.0 assuming that earth or muck removed from said working face retains the state it has taken in the exposed face, and said second coefficient $\eta_2$ is selected to be equal to the earth conveying efficiency $\eta$ of said screw conveyor varying depending on the nature of soil.

18. A control method as claimed in claim 11, wherein said first coefficient $\eta_1$ is a coefficient relating to the volume of removed earth or muck and is selected to be equal to the swell factor fs ($fs \geqq 1.0$) of earth or muck liberated into the atmosphere from the exposed face, and said second coefficient $\eta_2$ is selected to be equal to $fs \cdot \eta$ where $\eta$ is the earth conveying efficiency of said screw conveyor varying depending on the nature of soil.

19. A control method as claimed in claim 11, further comprising the steps of comparing said earth amount deviation with a predetermined reference value to produce a control signal representing the result of comparison thereby controlling at least one of said amount of removed earth and said amount of conveyed earth.

20. A control method as claimed in claim 11, wherein said earth amount deviation $\delta_1$ is given by $$\delta_1 = Q_1 - Q_2,$$

and said method further comprises the step of comparing $\delta_1$ with a reference value $\delta_o(\delta_0 > 0)$ to produce a control signal representing the result of comparison thereby controlling at least one of said amount of removed earth and said amount of conveyed earth.

21. A control method as claimed in claim 20, wherein said control signal is selected so as to maintain the rotating speed N of said screw conveyor constant when $\delta_1$ satisfies the relation $-\delta_0 < \delta_1 < \delta_0$, to increase the rotating speed N when $\delta_1$ satisfies the relation $\delta_1 \geqq \delta_0$, and to decrease the rotating speed N when $\delta_1$ satisfies the relation $\delta_1 \geqq -\delta_0$.

22. A control method as claimed in claim 20, wherein said control signal is selected so as to maintain the propelling speed v of said shield machine body constant when $\delta_1$ satisfies the relation $-\delta_0 < \delta_1 < \delta_0$, to decrease the propelling speed v when $\delta_1$ satisfies the relation $\delta_1 \geqq \delta_0$, and to increase the propelling speed v when $\delta_1$ satisfies the relation $\delta_1 \geqq -\delta_0$.

23. A control method as claimed in claim 11, further comprising the step of responding to an indication, by said chamber earth pressure signal, of an abnormal value of the earth pressure in said chamber so that said shield machine can operate to deal with the abnormal situation.

24. In a tunnel boring or shield machine of the earth-pressure control type including a chamber defined between a working face and a bulkhead mounted in a machine frame of a shield machine body, means for controlling the amount of earth or muck conveyed to the exterior from said chamber in which earth or muck is accumulated, and drive means for propelling the shield machine body toward and into the working face, an earth-pressure control system for ensuring stable boring operation by utilizing the earth pressure of earth or muck filling said chamber to prevent breakdown at the working face and comprising:

means for detecting the amount of earth or muck removed per unit time from said working face with the advancing movement of said shield machine body;

means for detecting the amount of earth or muck conveyed per unit time from said chamber by the conveying operation of said conveyed earth amount control means;

means for comparing the detected amount of earth or muck removed per unit time with the detected amount of earth or muck conveyed per unit time thereby producing a signal representing the earth amount deviation provided by the difference therebetween; and means for maintaining the earth pressure of the earth or muck filling said chamber within a predetermined range which does not give rise to breakdown of the exposed earth and rising of the ground, said means for maintaining including means for controlling at least one of said conveyed earth amount control means and said shield machine body drive means in response to said earth amount deviation signal to vary at least one of the amount of removed earth and the amount to conveyed earth.

25. In a tunnel boring or shield machine including a chamber defined between a working face and a bulkhead mounted in a machine frame of a shield machine body, means for controlling the amount of earth or muck conveyed to the exterior from said chamber in which earth or muck is accumulated, and drive means for propelling the shield machine body toward and into the working face, an earth-pressure control system for ensuring stable boring operation at the working face and comprising:

means for detecting the amount of earth or muck removed per unit time from said working face with the advancing movement of said shield machine body;

means for detecting the amount of earth or muck conveyed per unit time from said chamber by the conveying operation of said conveyed earth amount control means;

means for comparing the detected amount of earth or muck removed per unit time with the detected amount of earth or muck conveyed per unit time thereby producing a signal representing the earth amount deviation provided by the difference therebetween; and means for controlling at least one of said conveyed earth amount control means and said shield machine body drive means in response to said earth amount deviation signal to vary at least one of the amount of removed earth and the amount of conveyed earth to maintain the earth pressure in said chamber within a predetermined range which does not give rise to breakdown of the exposed face and rising of the ground and wherein said means for detecting the amount of earth or muck removed per unit time includes means for detecting the advancing speed of said shield machine body, first coefficient setting means for setting a first coefficient relating to the volume of removed earth or muck, and first multiplying means for multiplying the product of the detected advancing speed of said shield machine body and the sectional area of said shield machine body by said first coefficient to compute said amount of earth or muck removed per unit time; and said means for detecting the amount of earth or muck conveyed per unit time includes means for detecting the rotating speed of a screw conveyor included in said conveyed earth amount control means, second coefficient setting means for setting a second coefficient corresponding to the earth conveying efficiency of said screw conveyor varying depending on the nature of soil, and second multiplying means for multiplying the product of the detected rotating speed of said screw conveyor and the theoretical amount of earth or muck conveyed per one revolution of said screw conveyor by said second coefficient to compute said amount of earth or muck conveyed per unit time.

26. A control system as claimed in claim 25, wherein said first coefficient relating to the volume of removed earth or muck is selected to be 1.0 assuming that earth or muck removed from said working face retains the state it has taken in the exposed face, and said second coefficient is selected to be equal to the earth conveying efficiency of said screw conveyor varying depending on the nature of soil.

27. A control system as claimed in claim 25, wherein said first coefficient relating to the volume of removed earth or muck is selected to be equal to the swell factor of earth or muck liberated into the atmosphere from the exposed face, and said second coefficient is selected to be equal to the product of said swell factor and the earth conveying efficiency of said screw conveyor varying depending on the nature of soil.

28. A control system as claimed in claim 25, wherein said control means includes control deviation computing means for comparing said earth amount deviation $\delta_1$ with a predetermined reference value $\delta_0$ to produce a first control signal representing the result of comparison, and control signal connecting means for connecting said first control signal with at least one of said conveyed earth amount control means and said shield machine body drive means.

29. A control system as claimed in claim 28, wherein said first control signal produced as the result of comparison between said earth amount deviation $\delta_1$ and said reference value $\delta_0$ in said control deviation computing means is selected to maintain the rotating speed of said screw conveyor constant when $S_1$ satisfies the relation $-\delta_0<\delta_1<\delta_0$, to increase the rotating speed when $\delta_1$ satisfies the relation $\delta_1 \geqq \delta_0$, and to decrease the rotating speed when $\delta_1$ satisfies the relation $\delta_1 \leqq -S_0$.

30. A control system as claimed in claim 28, wherein said first control signal produced as the result of comparison between said earth amount deviation $\delta_1$ and said reference value $S_0$ in said control deviation computing means is selected so as to maintain the propelling speed of said shield machine body constant when $\delta_1$ satisfies the relation $-S_0\delta_1<\delta_0$, to decrease the propelling speed when $\delta_1$ satisfies the relation $\delta_1<\delta_0$, and to increase the propelling speed when $\delta_1$ satisfies the relation $\delta_1 \leqq -\delta_0$.

31. A control system as claimed in claim 28, wherein said control signal connecting means includes automatic-manual switching means having an input connected with said first control signal and another input connected with a second control signal externally applied for the manual control of at least one of said conveyed earth amount control means and said shield machine body drive means and having an output for producing a selected one of said first control signal and said second control signal in response to an automatic-manual switching signal externally applied thereto, and means for connecting the output of said switch means with at least one of said conveyed earth amount control means and said shield machine body drive means.

32. A control system as claimed in claim 25, further comprising means for detecting the earth pressure in said chamber and displaying the detected earth pressure.

33. A control system as claimed in claim 25, further comprising at least one of analog display means and digital display means for displaying at least one of said amount of earth or muck conveyed per unit time and said amount of earth or muck removed per unit time.

34. A control system as claimed in claim 25, further comprising means for detecting the earth pressure in said chamber to produce a signal representing the earth pressure, and earth pressure deviation computing means for comparing the detected chamber earth pressure provided by said signal with a predetermined reference value to produce a signal representing the earth pressure deviation provided by the result of comparison, said earth pressure deviation signal being applied to at least one of said first and second coefficient setting means whereby at least one of said first coefficient and said second coefficient is set in response to said earth pressure deviation signal.

35. A control system as claimed in claim 34, wherein said first coefficient relating to the volume of removed earth or muck is selected to be 1.0 assuming that earth or muck removed from said working face retains the state it has taken in the exposed face, and said second coefficient is set according to said earth pressure deviation signal.

36. A control system as claimed in claim 34, wherein said first coefficient relating to the volume of removed earth or muck is selected to be equal to the swell factor of earth liberated into the atmosphere from the exposed face, and said second coefficient is set according to said earth pressure deviation signal.

37. A control system as claimed in claim 34, wherein said control means includes control deviation computing means for comparing said earth amount deviation $\delta_1$ with a predetermined reference value $\delta_0$ to produce a first control signal connecting means for connecting said first control signal with at least one of said conveyed earth amount control means and said shield machine body drive means.

38. A control system as claimed in claim 37, wherein said first control signal produced as the result of comparison between said earth amount deviation $\delta_1$ and said reference value $\delta_0$ in said control deviation computing means is selected to maintain the rotating speed of said screw conveyor constant when $\delta_1$ satisfies the relation $-\delta_0<\delta_1<\delta_0$, to increase the rotating speed when $\delta_1$ satisfies the relation $\delta_1\geqq\delta_0$, and to decrease the rotating speed when $\delta_1$ satisfies the relation $\delta_1\geqq-\delta_0$.

39. A control system as claimed in claim 37, wherein said first control signal produced as the result of comparison between said earth amount deviation $\delta_1$ and said reference value $\delta_0$ in said control deviation computing means is selected so as to maintain the propelling speed of said shield machine body constant when $\delta_1$ satisfies the relation $-\delta_0<\delta_1<\delta_0$, to decrease the propelling speed when $\delta_1$ satisfies the relation $\delta_1\geqq\delta_0$, and to increase the propelling speed when $\delta_1$ satisfies the relation $\delta_1\leqq-\delta_0$.

40. A control system as claimed in claim 37, wherein said control signal connecting means includes automatic-manual switching means having an input connected with said first control signal and another input connected with a second control signal externally applied for the manual control of at least one of said conveyed earth amount control means and said shield machine body drive means and having an output for producing a selected one of said first control signal and said second control signal in response to an automatic-manual switching signal externally applied thereto, and means for connecting the output of said switching means with at least one of said conveyed earth amount control means and said shield machine body drive means.

41. A control system as claimed in claim 34, wherein said chamber earth pressure detecting means includes at least one earth pressure meter disposed in said chamber to provide an output which is delivered as said chamber earth pressure signal.

42. A control system as claimed in claim 34, wherein said chamber earth pressure detecting means includes at least one earth pressure detector disposed in said chamber, and means for averaging the output of said earth pressure detector to provide an output presenting the mean value of the detected earth pressure in said chamber, said output being delivered as said chamber earth pressure signal.

43. A control system as claimed in claim 34, wherein said chamber earth pressure detecting means includes at least one earth pressure detector disposed in said chamber, means for averaging the output of said earth pressure detector to provide an output representing the mean value of the detected earth pressure in said chamber, and means for differentiating the output of said averaging means with respect to time to provide an output representing the differentiated value of the mean value of the detected earth pressure in said chamber, said output being delivered as said chamber earth pressure signal.

44. A control system as claimed in claim 34, wherein said chamber earth pressure detecting means includes at least one earth pressure detector disposed in said chamber, means for averaging the output of said earth pressure detector to provide an output representing the mean value of the detected earth pressure in said chamber, means for differentiating the output of said averaging means with respect to time to provide an output representing the differentiated value of the mean value of the detected earth pressure in said chamber, and means for summing the output of said averaging means and the output of said differentiating means to provide an output representing the sum, said output being delivered as said chamber earth pressure signal.

45. A control system as claimed in claim 34, further comprising abnormal state detecting means responding to the output of said chamber earth pressure detecting means to produce an abnormal earth pressure signal when the detected earth pressure in said chamber indicates an abnormal value, said control means responding to said abnormal earth pressure signal so that at at least one of said conveyed earth amount control means and said shield machine body drive means can deal with the abnormal situation.

46. A control system as claimed in claim 34, wherein the rate of variation of each of said first and second coefficients varying depending on the level of said earth pressure deviation signal is less than a predetermined rate.

47. A control system as claimed in claim 34, further comprising at least one of analog display means and digital display means for displaying at least one of said amount of earth or muck conveyed per unit time and said amount of earth or muck removed per unit time.

48. A control system as claimed in claim 24, further comprising means for detecting the earth pressure in said chamber and displaying the detected earth pressure.

49. A control method as claimed in claim 1, further comprising the step of detecting the earth pressure in said chamber.

* * * * *

UNITED STATES PATENT AND TRADEMARK OFFICE

CERTIFICATE OF CORRECTION

PATENT NO. : 4,171,848

DATED : Oct. 23, 1979

INVENTOR(S) : Kozo Ono

It is certified that error appears in the above-identified patent and that said Letters Patent are hereby corrected as shown below:

On the front page, lefthand column, "[73] Assignee: Hitachi, Ltd., Japan" should read -- [73] Assignee: Hitachi Construction Machinery Co., Ltd., Tokyo, Japan --.

Signed and Sealed this

*Tenth* Day of *June 1980*

[SEAL]

*Attest:*

SIDNEY A. DIAMOND

*Attesting Officer*

*Commissioner of Patents and Trademarks*